US010029148B2

(12) United States Patent
Shieh

(10) Patent No.: US 10,029,148 B2
(45) Date of Patent: Jul. 24, 2018

(54) HEEL PROTECTIVE ADJUSTABLE SHOELACE

(71) Applicant: Shin-Shi Shieh, New Taipei (TW)

(72) Inventor: Shin-Shi Shieh, New Taipei (TW)

( * ) Notice: Subject to any disclaimer, the term of this patent is extended or adjusted under 35 U.S.C. 154(b) by 0 days.

(21) Appl. No.: 15/379,766

(22) Filed: Dec. 15, 2016

(65) Prior Publication Data

US 2018/0169477 A1 Jun. 21, 2018

(51) Int. Cl.
*A63B 31/11* (2006.01)

(52) U.S. Cl.
CPC ..... *A63B 31/11* (2013.01)

(58) Field of Classification Search
CPC ..... A63B 31/11
USPC ..... 441/61, 63, 64
See application file for complete search history.

(56) References Cited

U.S. PATENT DOCUMENTS 4,795,385 A * 1/1989 Matsuoka ..... A63B 31/11 441/64
6,227,924 B1 * 5/2001 Miller ..... A63B 31/11 441/64
8,087,959 B2 * 1/2012 Hsu ..... A63B 31/11 24/614

* cited by examiner

*Primary Examiner* — Anthony D Wiest
(74) *Attorney, Agent, or Firm* — Muncy, Geissler, Olds & Lowe, P.C.

(57) ABSTRACT

A heel protective adjustable shoelace, applied to an adjustable strap-type swimming fin, includes a heel pad, a heel protecting portion and two connecting adjusting straps. The heel protecting portion integrally extends along the longitudinal direction of the heel pad, and together with the heel pad define an accommodating space for accommodating and enveloping a heel and a wearing opening in communication with the accommodating space. The two connecting adjusting straps integrally extend from two opposite sides of the heel protecting portion corresponding to the wearing opening, respectively, to connect to a webbed member. A connection between the heel protective adjustable shoelace and the webbed member may be adjusted through the two connecting adjusting straps to match a foot length of a wearer. Further, a heel of a wearer is prevented from being cut by an external object such as corals and reefs during a scuba diving activity.

8 Claims, 6 Drawing Sheets

HEEL PROTECTIVE ADJUSTABLE SHOELACE

FIELD OF THE INVENTION

The present invention relates to a swimming fin shoelace, and particularly to a heel protective adjustable shoelace for a strap-type swimming fin. The heel protective adjustable shoelace allows a wearer to freely adjust a connection between the wearer and a webbed member, completely protects a heel of the wearer and may be easily put on and removed.

BACKGROUND OF THE INVENTION

Current swimming fins are mainly categorized into full-foot swimming fins and adjustable strap-type swimming fins. Referring to FIG. 1 for a so-called full-foot swimming fin, a full-foot swimming fin 80 provides a shoe portion 81 having a fixed shoe size for a wearer to put on. However, the design of the shoe portion 81 is unfavorable for promptly putting on and removing for a wearer, and the fixed size of the shoe portion 81 also causes an associated developer and manufacturer to especially design a shoe shape or size for each wearer. In general, 6 to 9 differently-sized pairs need to be provided for every single style of the full-foot swimming fin 80 to accommodate the issue of different foot sizes of the public. More specifically, for the full-foot swimming fin 80, the 6 pairs mean that 6 pairs in different shoe sizes including XL, L, ML, M, S and XS need to be manufactured, and the 8 pairs mean that 9 pairs in different shoes sizes including XXXL, XXL, XL, L, ML, M, S, XS, and XXS need to be manufactured. As such, a developer and manufacturer needs to produce a predetermined number for each of the above sizes, which is equivalently producing large amounts of inventory that may be quite uneconomical. A distributor is also required to purchase stock of each of the above sizes for satisfy public needs, which again leads to large amounts of inventory. Further, the size of each full-foot swimming fin 80 is fixed, in a way that a rental provider is similarly required to prepare all of the sizes in order to cater the needs of all renting customers.

On the other hand, referring to FIG. 2 for an adjustable strap-type swimming fin, an adjustable strap-type swimming fin 90 is mainly formed by a webbed member 91 and a strap 92. The webbed member 91 provides a space 911 to be worn by only a front part of a human foot, and the strap 92 may be selectively connected to the webbed member 91. During the process of putting on, the front part of a foot of a wearer is placed in the space 911, and the strap 92 is wound around an ankle of the wearer to complete the process. Such method allows a wearer to adjust the size of the adjustable strap-type swimming fin 90. However, when the adjustable strap-type swimming fin 90 is put on, a heel of the wearer is unprotected by the adjustable strap-type swimming fin 90 and remains exposed. As a result, during scuba diving activities, the wearer may be easily cut but by external objects such as corals or reefs.

SUMMARY OF THE INVENTION

It is an object of the present invention to solve issues of a conventional full-foot swimming fin, which has a fixed size in a way that a wearer cannot easily put on and remove the full-foot swimming fin and can be worn only when the fixed size matches that of the wearer.

It is another object of the present invention to solve issues of a conventional strap-type swimming fin, which is incapable of protecting a heel of a wearer in a way that the wearer is likely cut by external objects such as corals and reefs.

To achieve the above object, the present invention provides a heel protective adjustable shoelace applied to an adjustable strap-type swimming fin. The heel protective adjustable shoelace includes a heel pad, a heel protecting portion and two connecting adjustable straps. The heel protecting portion extends along the longitudinal direction of the heel pad, and together with the heel pad define an accommodating space for accommodating and enveloping a heel and a wearing opening in communication with the accommodating space. The two connecting adjustable straps integrally extend from two opposite sides of the heel protecting portion corresponding to the wearing opening, respectively, to connect to a webbed member.

In one embodiment, the heel protective adjustable shoelace further includes an extended protecting portion that extends from the heel pad towards a direction away from the heel protecting portion.

In one embodiment, when the heel protective adjustable shoelace is connected to the webbed member, an upper surface of the heel pad is lower than a lower surface of the webbed member, such that the extended protecting portion comes into contact with the lower surface of the webbed member.

In one embodiment, the heel pad has a first thickness, the extended protecting portion has a second thickness, and the first thickness is greater than the second thickness.

In one embodiment, the heel protecting portion includes a middle section, and two side sections each extending from one side of the middle section. The middle section gradually inclines in a direction away from the heel pad towards the wearing opening.

In one embodiment, each of the connecting adjustable straps includes a second fastening element, which selectively fastens with a first fastening element on the webbed member to form a connection.

In one embodiment, the first fastening element is a female fastening element, and the second fastening element is a male fastening element.

In one embodiment, each side of the connecting adjusting straps facing the wearing opening is provided with a plurality of limiting protrusions, which are spaced and limit the second fastening element from moving randomly.

In one embodiment, the heel protective adjustable shoelace is entirely formed by rubber or synthetic resin.

In one embodiment, the heel protective adjustable shoelace further includes a pull ring integrally extended from the heel protecting portion and provided with a through hole.

With the foregoing implementation, the present invention provides following features compared to conventional solutions.

In addition to the heel pad, the heel protective adjustable shoelace of the present invention further includes the heel protecting portion, such that a wearer is prevented from being cut by external objects such as corals or reefs during a scuba diving activity. Meanwhile, the wearer may adjust the connection between the heel protective adjustable shoelace and the webbed member through the two connecting adjusting straps to match a foot length of the wearer and to allow the wearer to put on and remove the swimming fin easily. Further, based on the implementation of the disclosure, 6 pairs of differently-sized swimming fins conventionally manufactured may be replaced by swimming fins in a large size and in a small size (e.g., ML and XS), and 9 pairs of differently-sized swimming fins conventionally manufactured may be replaced by swimming fins in a three different sizes (e.g., XXL, ML and XS). Thus, large amounts for molds and operation costs caused by inventory of different sizes can be eliminated to provide an extremely economical solution.

DETAILED DESCRIPTION OF THE PREFERRED EMBODIMENTS

Details and technical contents of the present invention are given with the accompanying drawings below.

Figure 5:
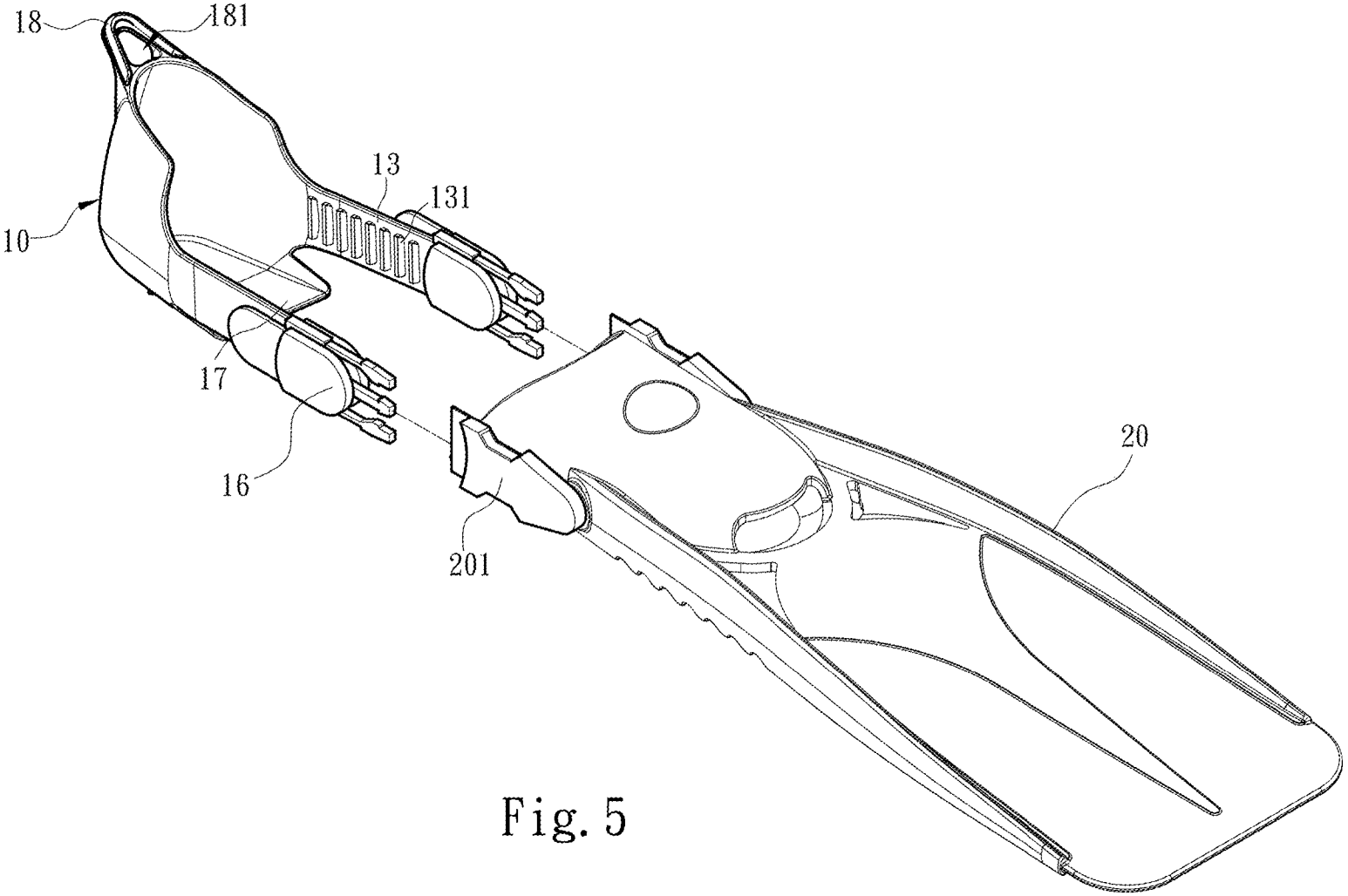
FIG. 5 is a schematic diagram showing a connection with a webbed member according to an embodiment of the present invention.

Referring to FIG. 3 to FIG. 6, the present invention provides a heel protective adjustable shoelace 10 applicable to an adjustable strap-type swimming fin. More specifically, the heel protective adjustable shoelace 10 may replace a strap (not shown) included in a conventional adjustable strap-type swimming fin, and be connected to a webbed member 20 of the adjustable strap-type swimming fin to together form a swimming fin. The heel protective adjustable shoelace 10 may be entirely made of rubber or synthetic resin, and includes a heel pad 11, a heel protecting portion 12 and two connecting adjusting straps 13. The heel pad 11 may be in an ergonomic form similar to a heel. The heel protecting portion 12 integrally extends along the longitudinal direction (e.g., a direction 30 shown) of the heel pad 11, and has an extension height that may be correspondingly adjusted according to application requirements. In one embodiment, the heel protecting portion 12 at least extends by a height to sufficiently cover the heel of a wearer. Further, the heel protecting portion 12 and the heel pad 11 together define an accommodating space 14 for accommodating and enveloping a human heel, and a wearing opening 15 in communication with the accommodating space 14. The accommodating space 14 is provided based on ergonomics such that a wearer feels comfortable when wearing the swimming fin. More specifically, in the present invention, the heel protecting portion 12 is formed at a rear side of a human heel and two opposite sides connected to the rear side when the human heel is placed on the heel pad 11. In continuation, the heel protecting portion 12 of the present invention includes a middle section 121 corresponding to the rear side of the human heel, and two side sections 122 and 123 each extending from one side of the middle section 121 and corresponding to the sides of the human heel. In one embodiment, to have the heel protecting portion 12 better conform to a posture of the human heel, the middle section 121 gradually inclines in a direction (as a direction 31 shown) away from the heel pad 11 towards the wearing opening 15, as shown in FIG. 5.

Further, the two connecting adjusting straps 13 integrally extend from two opposite of the heel protecting portion 12 corresponding to the wearing opening 15, respectively, to connect to the webbed member 20. Further, each of the connecting adjusting strap 13 integrally extends from one of the side sections 122 and 123 of the heel pad 11 towards a direction away from the heel pad 11, and the two connecting adjusting straps 13 are located on the same horizontal plane and are designed as identical structures. Further, the connection between each of the connecting adjusting straps 13 and the webbed member 20 is completed by a connecting structure. In one embodiment, each of two outer opposite sides is provided with a first fastening element 201, and each of the connecting adjusting straps 13 includes a second fastening element 16 that may selectively form a connection with the first fastening element 201. The second fastening elements 16 are respectively accommodated around the connecting adjusting straps 13, and are operable to slide and move on the respectively located connecting adjusting straps 13 in a restricted manner. In brief, when the second fastening elements 16 are connected to the first fastening elements 201, respectively, a user may further manipulate positions of the second fastening elements 16 on the respective connecting adjusting straps 13, so as to adjust distances between the present invention and the webbed member 20. In one embodiment, each of the first fastening elements 201 may be a female fastening element, and each of the second fastening elements 16 may be a male fastening element. Further, the first fastening elements 201 may be designed to rotate relative to the webbed member 20. Thus, when the first fastening elements 201 are respectively assembled to the second fastening elements 16, a wearer may apply a force on the heel protective adjustable shoelace 10 to cause the second fastening elements 16 to rotate the respective first fastening elements 201, hence allowing the wearer to more easily remove the present invention. Further, on the side facing the wearing opening 15, each of the connecting adjusting straps 13 is provided with a plurality of limiting protrusions 131 that are spaced and limit the second fastening element 16 from moving randomly. Gaps and form of the limiting protrusions 131 may be correspondingly adjusted according to actual application requirements. Further, the form of one of the limiting protrusions 131 that is farthest away from the heel protecting portion 12 may be different from that of others, so as to prevent the second fastening element 16 from disengaging.

Figure 6:
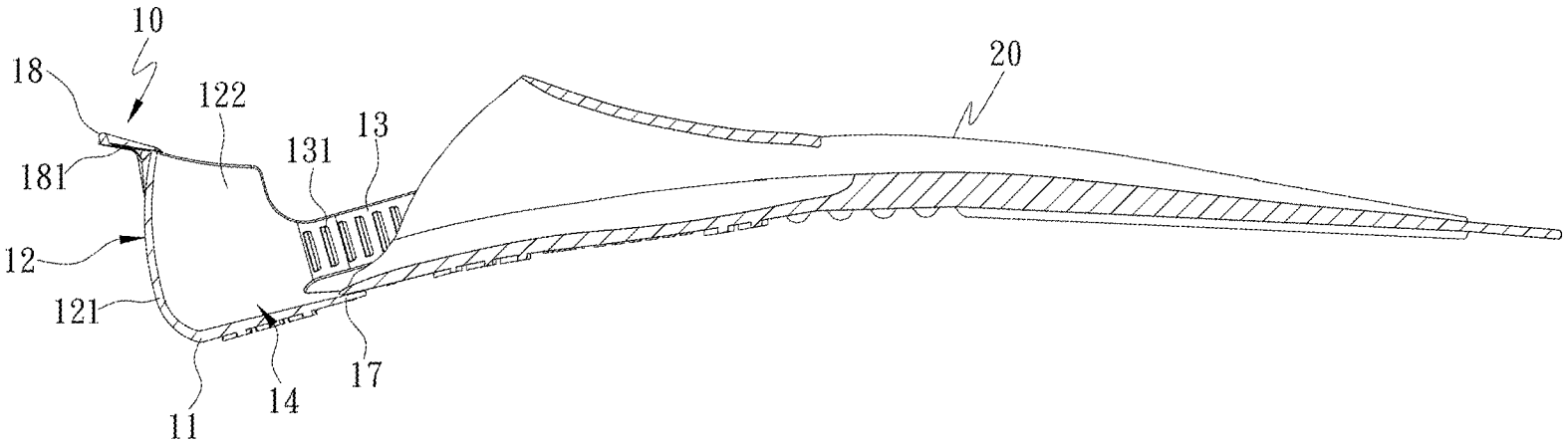
FIG. 6 is a section view of a connection with a webbed member according to an embodiment of the present invention.

Referring to FIG. 6, in one embodiment, the heel protective adjustable shoelace 10 further includes an extended protecting portion 17, which extends from the heel pad 11 towards a direction away from the heel protecting portion 12. The form of the extended protecting portion 17 may be as shown in the drawing, or may be correspondingly designed and adjusted according to actual application requirements. Further, the design object of the extended protecting portion 17 is to preserve a gap between the heel protective adjustable shoelace 10 and the webbed member 20 when the two are connected, so as to provide better protection for an arch of the foot of the wearer. In one embodiment, when the heel protective adjustable shoelace 10 and the webbed member 20 are connected, an upper surface of the heel pad 11 is lower than a lower surface of the webbed member 20, such that the extended protecting portion 17 extends to come into contact with the lower surface of the webbed member 20. Further, in the present invention, the heel pad 11 has a first thickness 111, the extended protecting portion 17 has a second thickness 171, and the first thickness 111 is greater than the second thickness 171. With the above implementation, in addition to providing a wearer a better protection effect, more ideal wearing experiences are also offered.

Figure 1:
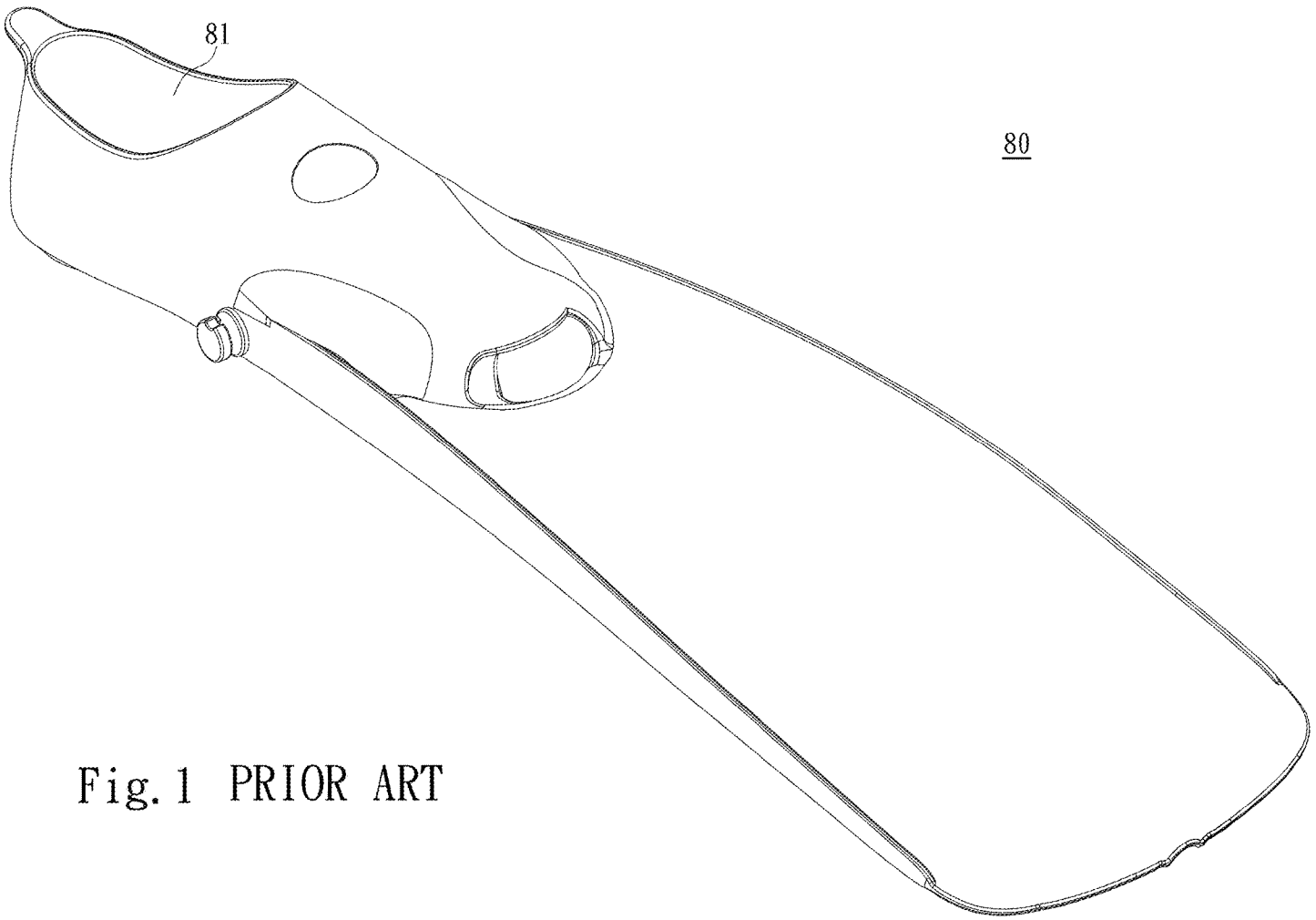
Fig. 1 PRIOR ART
FIG. 1 is a schematic diagram of a conventional full-shoe swimming fin.
Figure 2:
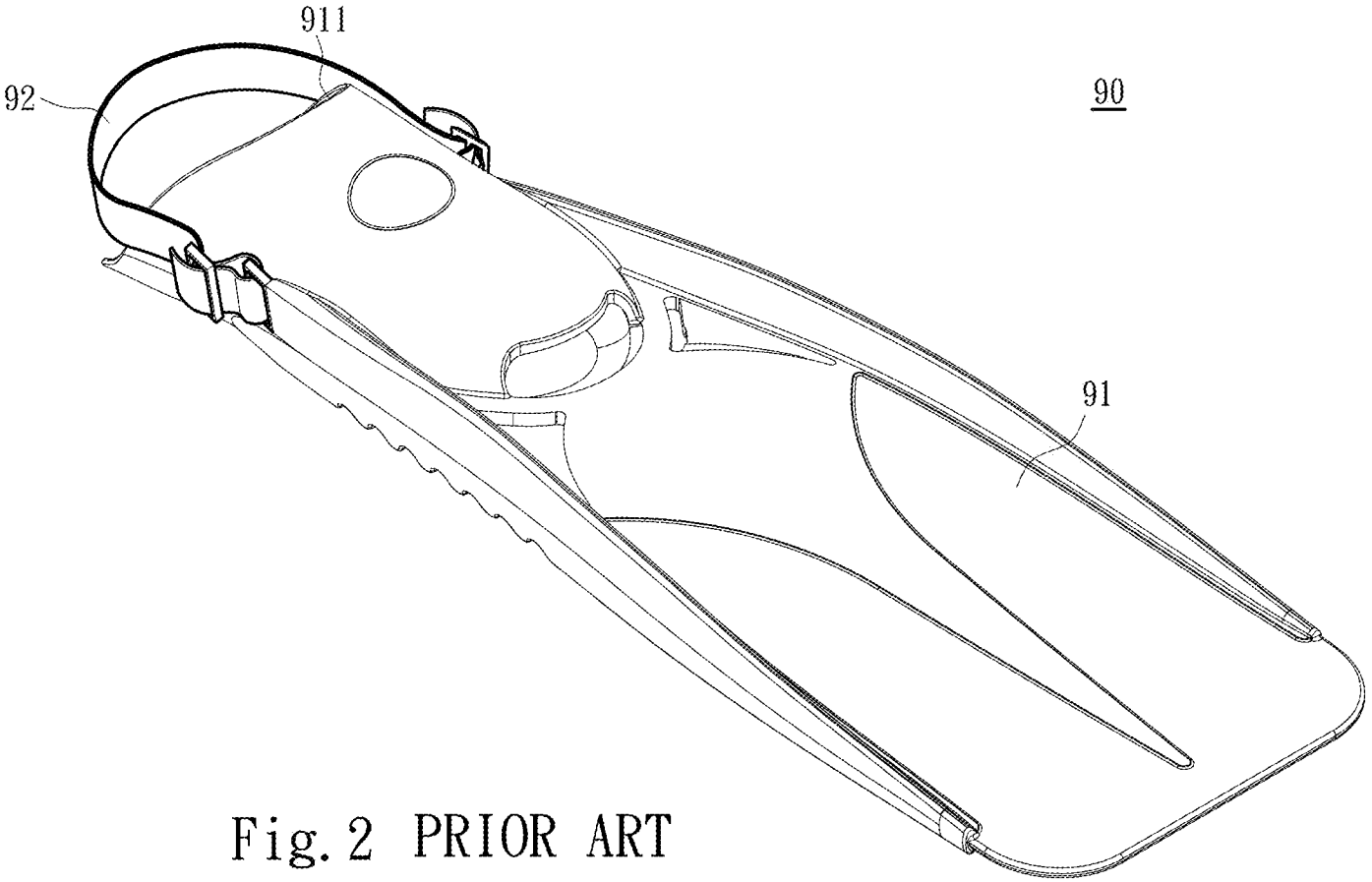
Fig. 2 PRIOR ART
FIG. 2 is a schematic diagram of a conventional adjustable strap-type swimming fin.
Figure 3:
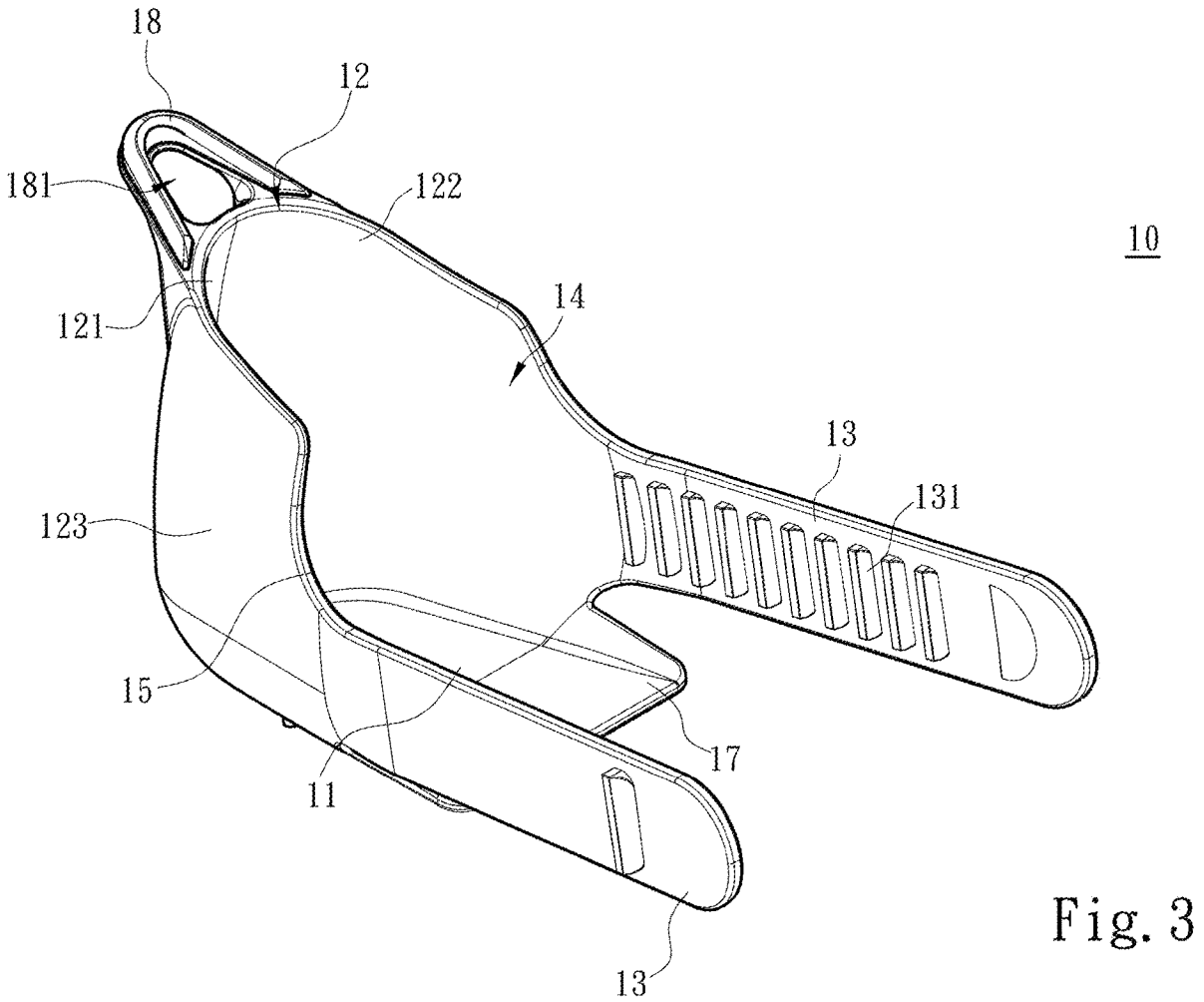
FIG. 3 is a schematic diagram of a structure according to an embodiment of the present invention.
Figure 4:
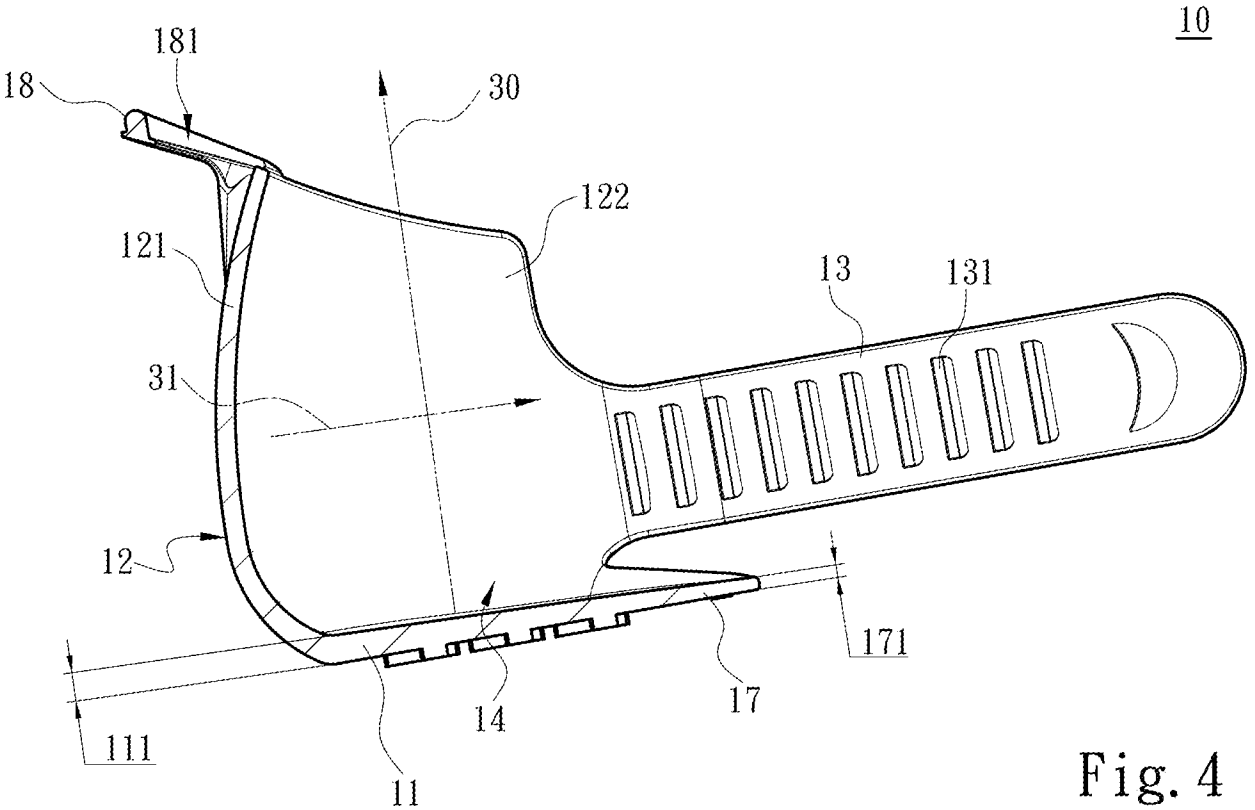
FIG. 4 is a section view according to an embodiment of the present invention.

Referring to FIG. 3, in one embodiment, the heel protective adjustable shoelace 10 further includes a pull ring 18 that integrally extends from the heel protecting portion 12. The pull ring 18 provides assistance when a wearer puts on or removes the present invention. Further, the pull ring 18 includes a through hole 181, which may be inserted by a finger of the wearer to apply a force to remove the heel protective adjustable shoelace 10 of the present invention.

What is claimed is:

1. A heel protective adjustable shoelace, applied to an adjustable strap-type swimming fin, comprising:

a heel pad;

a heel protecting portion, integrally extending along the longitudinal direction of the heel pad, together with the heel pad defining an accommodating space for accommodating and enveloping a heel and a wearing opening in communication with the accommodating space, the heel protecting portion including a middle section facing the rear side of the heel and two side sections facing two sides of the heel, the two side sections respectively extending from one side of the middle section to wrap an ankle;

an extended protecting portion, extending from the heel pad towards a direction away from the heel protecting portion; and two connecting adjusting straps, integrally extending from the two side sections of the heel protecting portion corresponding to the wearing opening, respectively, to connect to a webbed member;

wherein when the heel protective adjustable shoelace is connected to the webbed member, an upper surface of the heel pad is lower than a lower surface of the webbed member to cause the extended protecting portion coming into contact with the lower surface of the webbed member; and wherein the heel protective adjustable shoelace defines a first distance and a second distance shorter than the first distance, the first distance extending from a top edge of one of the side sections to a top edge of the connecting adjusting strap on the same side of the side section, and the second distance extending from a bottom edge of the connecting adjusting strap to the upper surface of the heel pad.

2. The heel protective adjustable shoelace of claim 1, wherein the heel pad has a first thickness, the extended protecting portion has a second thickness, and the first thickness is greater than the second thickness.

3. The heel protective adjustable shoelace of claim 1, wherein the heel protecting portion comprises a middle section and two side sections each extending from one side of the middle section, and the middle section gradually inclines in a direction away from the heel pad towards the wearing opening.

4. The heel protective adjustable shoelace of claim 1, wherein each of the connecting adjusting straps comprises a second fastening element that selectively connects to a first fastening element on the webbed member.

5. The heel protective adjustable shoelace of claim 4, wherein the first fastening element is a female fastening element, and the second fastening element is a male fastening element.

6. The heel protective adjustable shoelace of claim 4, wherein each of the connecting adjusting straps comprises a plurality of limiting protrusions that are spaced and limit the second fastening element from moving randomly.

7. The heel protective adjustable shoelace of claim 1, being entirely made of rubber or synthetic resin.

8. The heel protective adjustable shoelace of claim 1, further comprising a pull ring integrally extending from the heel protecting portion and provided with a through hole.

* * * * *